US005175567A

United States Patent [19]

Asai

[11] Patent Number: 5,175,567

[45] Date of Patent: Dec. 29, 1992

[54] RECORDING APPARATUS AND RECORDING HEAD HAVING AN IMPROVED DISCHARGE POST ARRANGEMENT

[75] Inventor: Naohito Asai, Yokohama, Japan

[73] Assignee: Canon Kabushiki Kaisha, Tokyo, Japan

[21] Appl. No.: 649,846

[22] Filed: Feb. 1, 1991

[30] Foreign Application Priority Data

Feb. 2, 1990 [JP] Japan ..... 2-022171

[51] Int. Cl.[5] ..... B41J 2/145

[52] U.S. Cl. ..... 346/140 R

[58] Field of Search ..... 346/140

[56] References Cited

U.S. PATENT DOCUMENTS

| | | | |
|---|---|---|---|
| 4,090,205 | 5/1978 | Huffman | 346/75 |
| 4,185,290 | 1/1980 | Hoffman | 346/75 |
| 4,313,124 | 1/1982 | Hara | 346/140 R |
| 4,313,684 | 2/1982 | Tazaki | 346/140 X |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,586,054 | 4/1986 | Kurita | 346/76 PH |
| 4,723,129 | 2/1988 | Endo et al. | 346/1.1 |
| 4,740,796 | 4/1988 | Endo et al. | 346/1.1 |
| 4,740,800 | 4/1988 | Kyoshima | 346/140 |

FOREIGN PATENT DOCUMENTS

| | | |
|---|---|---|
| 317342 | 5/1989 | European Pat. Off. . |
| 133338 | 10/1979 | Japan . |
| 63-205242 | 8/1988 | Japan . |
| WO87/0033-63 | 6/1987 | PCT Int'l Appl. . |

*Primary Examiner*—Joseph W. Hartary

*Attorney, Agent, or Firm*—Fitzpatrick, Cella, Harper & Scinto

[57] ABSTRACT

An ink jet recording head comprises a plurality of ink discharge ports for discharging ink, a plurality of ink paths each communicating with one of the discharge ports and a thermal energy generating device provided in each ink path for generating thermal energy to be applied to the ink. The discharge ports are so arranged that the opening areas of the liquid discharge ports located at both end regions in an arrangement direction of the discharge ports are larger than that of the liquid discharge ports located at a central region. Inconsistencies in the size of ink droplets discharged from the discharge ports, can, therefore, be prevented. Such size differentials could have occurred due to the difference of viscosity that is caused because the temperature of the ink is higher at the central region and lower at both end regions. A recorded image having no unevenness in recording density can be formed.

24 Claims, 13 Drawing Sheets

RECORDING APPARATUS AND RECORDING HEAD HAVING AN IMPROVED DISCHARGE POST ARRANGEMENT

BACKGROUND OF THE INVENTION

1. Field of the Invention

The present invention relates to a liquid jet recording head that carries out a recording operation by acting thermal energy on recording liquid and discharges the recording liquid from discharge ports and an apparatus having a recording mechanism using said recording head.

2. Related Background Art

A liquid jet recording head applied to, for example, a liquid jet recording apparatus is generally provided with liquid discharge ports which serve for discharging and ejecting recording liquid to produce flying droplets, liquid passages each communicating with each discharge port and an energy generating means which is provided in a part of the liquid passage and generates energy utilized for obtaining flying liquid droplets from the recording liquid stored in the liquid passage.

Exemplary energy generating means of the above mentioned energy generating means are a pressure energy means represented by an electromechanical converter such as a piezoelectric element, etc., an electromagnetic wave energy generating means for applying electromagnetic wave such as laser, etc., to recording liquid to form flying liquid droplets, or an electrothermal converter, which have been all well-known.

The liquid jet recording head employing a thermal energy generating means such as the above-mentioned electrothermal converter can conduct a recording with high resolution, since the liquid discharge ports used for forming the flying liquid droplets required for recording can be arranged with high density. The miniaturization of the recording head can be easily made. Further, in the process of manufacturing the recording head, the advantages of IC technology or micronization technology which have been recently significantly improved from the viewpoint of reliability and progress in the field of semiconductor can be adopted as much as possible. It is also possible to readily lengthen the size of the recording head or to achieve the planer use thereof (in two-dimensional way). It is noted that, with the above described points considered, that the multi-nozzle formation and high density of the recording head can be attained without difficulty, in addition to that, a large quantity of recording heads can be manufactured with high productivity and at low production cost. The recording head using the above thermal energy generating means is, therefore, worthy of note.

FIG. 1 shows an example of a conventional liquid jet recording head provided with such a thermal energy generating means. The recording head 101 has a structure that electrothermal converters 103 as thermal energy generating means, electrodes 104, liquid passage walls 105 and a top plate 106 are provided on a substrate 102 through processes for manufacturing semiconductors which make use of various processes including etching, vapor deposition, sputtering or the like. Recording liquid 112 is supplied from a recording liquid tank not shown to the common liquid chamber 108 of the recording head 101 through a liquid supply pipe 107. The recording liquid 112 supplied to the common liquid chamber 108 is supplied to liquid passages 110 in accordance with for example, capillary phenomenon and forms a meniscus in each liquid discharge port 111 placed at the end of each liquid passage 110, so that it is stably retained.

To discharge the recording liquid by utilizing the recording head 101 constructed as above, for instance, the electrothermal converters 103 are energized in the form of pulsation. As a result of the energization of the electrothermal converters 103, the recording liquid 112 located in the vicinity of the electrothermal converters 103 is rapidly heated. The rapid heating thereof produces foaming phenomenon in the recording liquid 112. The foaming energy generated from the foaming phenomenon enables liquid droplets to be discharged from the liquid discharge ports 111. With reference to the liquid jet recording head 101 using such thermal energy generating means, a liquid jet recording head can be obtained with ease and high productivity that has, for example, a construction mentioned above and the arrangement of discharge ports provided with such a high density as 16/mm for example, and that is a multi-nozzle type having 128 or 256 nozzles.

The liquid jet recording head of multi-nozzle type in which the thermal energy generating means such as the aforementioned electrothermal converters are disposed with high density is generally designed so that the length of each liquid passage on the substrate 102, the cross-sectional area of each liquid passage, each liquid discharge port area, the distance between each liquid discharge port and each electrothermal converter, the heating area of each electrothermal converter or the like are respectively equal in every nozzle of the multiple nozzles in order to maintain the uniformity of liquid droplets emitted from the respective liquid discharge ports.

However, the liquid jet recording head provided with the above construction, is, during recording operation by the head, liable to diffuse more heat at both ends than at a central portion with respect to a direction where the liquid passages are arranged, which leads to the generation of a temperature gradient in the substrate 102. Accordingly, as shown in FIG. 2, it is apparent that the temperature at the end regions of the multi-nozzle type substrate is inclined to become lower than the temperature at the central region thereof.

As an exemplary recording liquid for use with the liquid jet recording head, a product obtained by, for example, dissolving or dispersing coloring agent such as dyestuff, pigment, etc., into aqueous or oily liquid is typically used. It is well-known that the viscosity of the recording liquid is greatly dependent on the temperature of the recording liquid, regardless of the recording liquid used. FIG. 3 illustrates an example of the dependency of viscosity of the recording liquid on the temperature thereof used in a liquid jet recording head. As apparent from FIG. 3 the viscosity of the recording liquid declines as the temperature thereof rises. In contradistinction thereto, as the temperature of the recording liquid declines, the viscosity thereof rises. As described above, the generation of temperature gradient in the substrate thus causes the viscosity of ink to be decreased at the central portion of the recording head where temperature is high. On the contrary, the viscosity of ink is higher near the two ends where temperature is low.

The phenomenon that the higher the temperature of the recording liquid rises, the lower the viscosity thereof becomes does not merely indicate that the viscosity of the recording liquid changes. For example, even though thermal energy applied to recording liquid from each thermal energy generating means is the same, the volume of liquid droplet emitted from each liquid discharge port 111 is increased or decreased or recording liquid low in viscosity inevitably produces a broader expansion of recording dot, that is, larger dot area on a material to be recorded than that produced using a recording liquid high in viscosity as shown in FIG. 4, when the droplets stick to and are deposited on the material to be recorded such as paper to form the recording dot. According to the above phenomenon, recording cannot be done with desired and stable density.

Namely, when the aforementioned temperature gradient is produced in the substrate 102 in the multi-nozzle type liquid jet recording head and the temperature at both end regions is lower compared with that at a central region, an inconvenience arises in that the viscosity of recording liquid in the central region of the liquid passage 110 is decreased in comparison with the liquid in the end regions and the volume of liquid droplets discharged from the liquid discharge ports 111 at the central region and the dot area of the recording liquid where the discharged droplets come into contact with a material to be recorded and are recorded become larger than those at the end regions.

FIG. 5 shows a graph designating the relation between the recording density of recording liquid emitted from each discharge port 111 and a substrate position when the temperature gradient appears in the substrate 102 of the conventional liquid jet recording head.

Such unevenness in recording density especially appears where all the thermal energy generating means of the recording head are heated and the head repeatedly scans and reciprocates on a material to be recorded such as a recording sheet perpendicularly to the feeding direction of the recording sheet as if the entire surface of the recording sheet were completely painted. In this case, the unevenness in recording density is, as illustrated in FIG. 6, repeatedly produced for every line, and accordingly, variable densities are undesirably repeatedly distinguished.

SUMMARY OF THE INVENTION

For overcoming the above-mentioned drawbacks, a primary object of the present invention is to provide a liquid jet recording head having a simple structure in which unevenness in recording density caused by temperature difference in the recording head is eliminated so that a recorded image with high quality can be obtained and an apparatus having a recording mechanism using said recording head.

Another object of the present invention is to provide a liquid jet recording head comprising a plurality of liquid discharge ports so arranged that recording liquid can be discharged in a desired direction, liquid passages each communicating with each liquid discharge port and thermal energy generating means each provided for acting thermal energy on the recording liquid contained in the liquid passage characterized in that the areas of the liquid discharge ports located at end positions of the arrangement of the liquid discharge ports are larger than that of the liquid discharge port located at a central position thereof.

Still another object of the present invention is to provide an apparatus having a liquid jet recording head comprising a plurality of liquid discharge ports so arranged as to eject recording liquid in a desired direction, liquid passages each communicating with each liquid discharge port and thermal energy generating means each provided in the liquid passage for acting thermal energy on the recording liquid contained in the liquid passage, the liquid discharge ports located at end positions of the arrangement of the liquid discharge ports having larger areas than the liquid discharge port located at the central position of the arrangement and a carrying means for carrying a recording medium.

A further object of the present invention is to provide a liquid jet recording head comprising a plurality of liquid discharge ports so arranged to discharge recording liquid, liquid passages each communicating with each liquid discharge port and thermal generating means each provided in each liquid passage, said liquid discharge ports being so designed that the areas of the liquid discharge ports are gradually increased from the liquid discharge port located at the central portion of the arrangement thereof toward the liquid discharge ports located at both end portions of the arrangement and an apparatus having a recording mechanism by the use of said recording head.

DETAILED DESCRIPTION OF THE PREFERRED EMBODIMENTS

The following is described to explain embodiments of the present invention in detail with reference to accompanied drawings.

Figure 1:
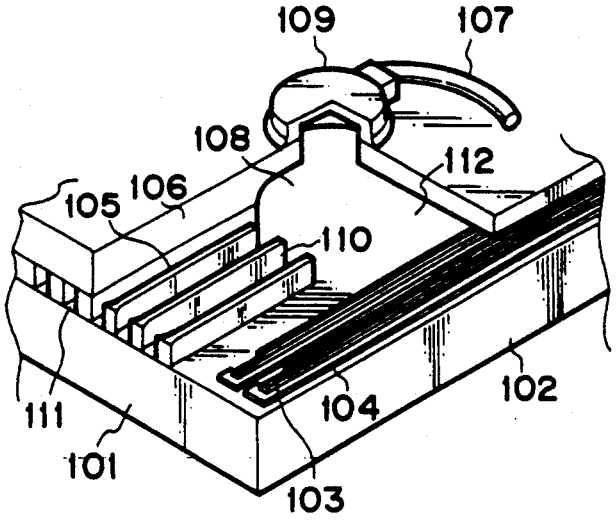
FIG. 1 PRIOR ART
FIG. 1 is a perspective view showing the construction of a conventional liquid jet recording head.
Figure 7:
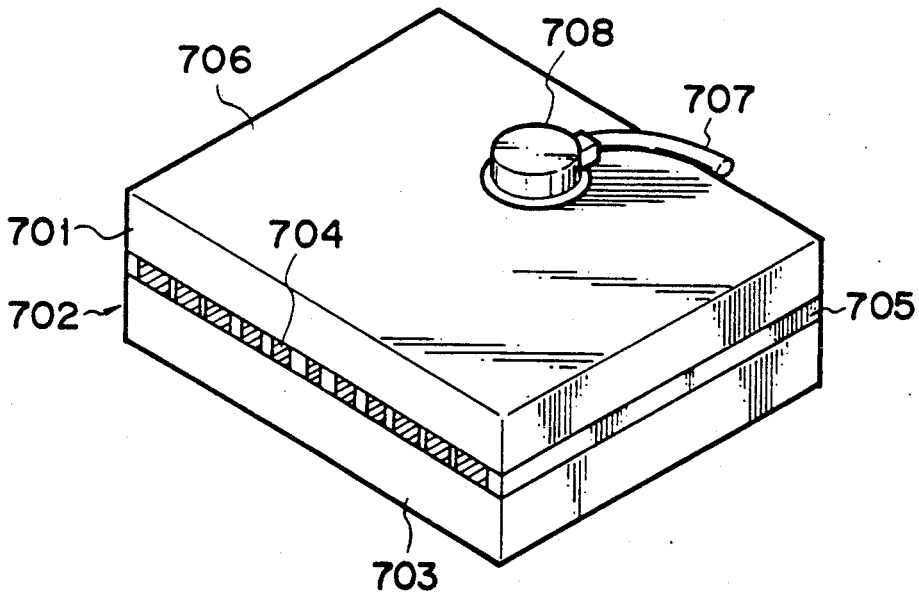
FIG. 7 is a perspective view illustrating one embodiment of the construction of a liquid jet recording head of the present invention.

FIG. 7 shows a liquid jet recording head as one preferred embodiment of the present invention. In FIG. 7, 701 denotes a liquid jet recording head, 703 is a substrate thereof and 704 denotes a plurality of liquid discharge ports arranged on the substrate 703. Liquid passages communicating with the respective liquid discharge ports 704, which are not specifically shown in FIG. 7, are provided in a similar manner to that shown in FIG. 1. In each liquid passage on the substrate 703, an electrothermal converter as a thermal energy generating means is disposed so as to correspond to each liquid passage. Although a number of liquid discharge ports 704 and electrothermal converters are arranged with high density, the formation of each liquid discharge port, the material of the substrate 703 or the like may not be particularly limited.

As an exemplary energy generating means, an electrothermal converter, in other words, electrothermal converter employing, for example, an exothermic resistor such as $HfB_2$ may be typical one. It is noted that thermal energy generating means other than the above-said electrothermal converter may also be used.

In this embodiment, the opening areas of the liquid discharge ports formed on the liquid discharge face 702 of the recording head 701 are constructed in such a way that they gradually increase from the central portion toward both end parts in the direction of arrangement of the liquid discharge ports 704. Namely, since the height of each liquid passage wall 705 is set to a fixed level in this embodiment, widths of the liquid discharge ports 704 become larger as they approach the two to end portions from the central portion in the direction of the arrangement of the liquid discharge ports. This arrangement of the discharge ports enables the opening areas of the discharge ports to be varied, as shown by (B) in FIG. 8. As described above, the opening area of the liquid discharge port 704 which is disposed at the central portion of the arrangement of the liquid discharge ports of the substrate 703 where temperature is higher than that at both end portions is made smaller than those of the liquid discharge ports 704 which are placed at both end portions of the arrangement thereof. This is helpful to that size of liquid droplets formed of recording liquid retained in the state of low viscosity which are discharged from the liquid discharge port located at the central portion of the substrate is kept equal to that of liquid droplets formed of recording liquid retained in the state of high viscosity which is discharged from the liquid discharge ports located at both end portions of the substrate. In addition thereto, as clearly shown by (C) in FIG. 8, recording density can be made equal at any position of the liquid discharge ports on the substrate 703.

Figure 8:
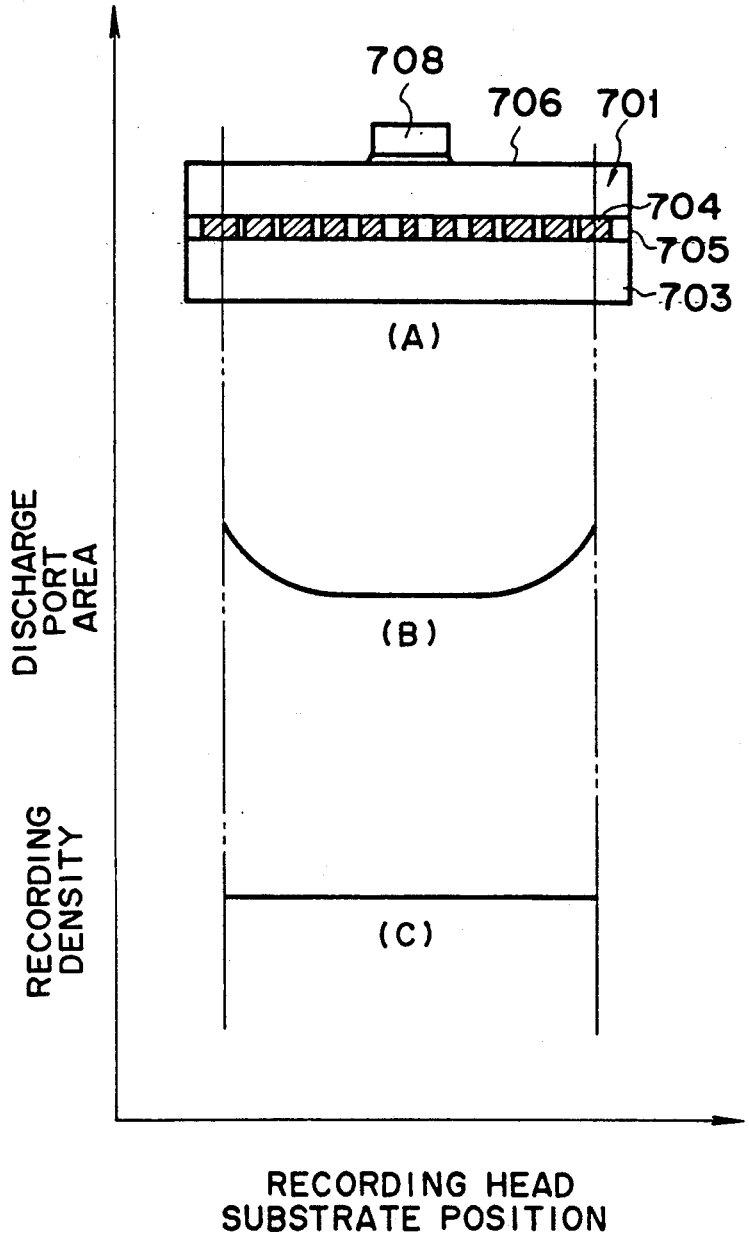
FIG. 8 is an explanatory view of a manner in which liquid discharge ports are formed in accordance with the present invention.
Figure 9:
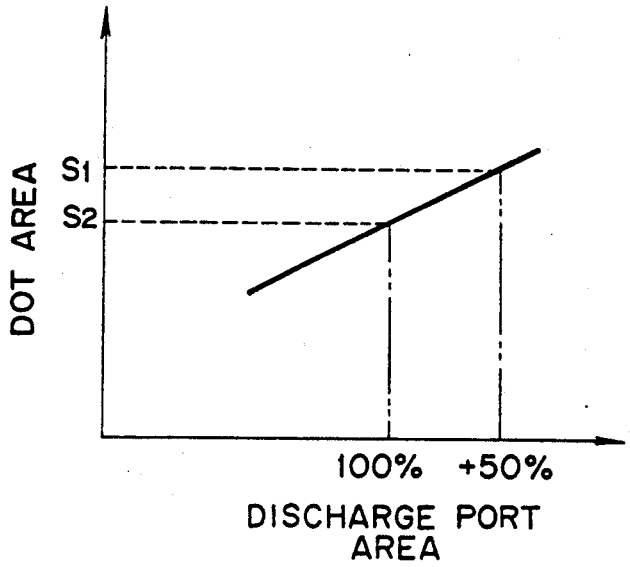
FIG. 9 shows the relation between discharge port area and formed dot area.
Figure 10:
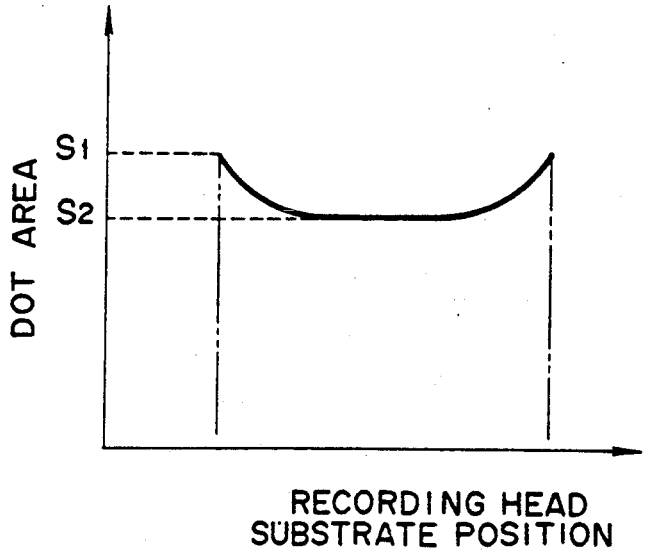
FIG. 10 shows the distribution of the dot area formed provided that temperature gradient is not produced on a substrate according to the present invention.

This relation between the opening area of the discharge port and the size of the liquid droplet will be explained by way of FIGS. 9 and 10. Between a discharge port area and a dot area on a face to be recorded of a material to be recorded such as a sheet which is formed of liquid droplet, there is a relation, for example, shown in FIG. 9. Now, if the discharge port area of 100% is increased by 50% more to have the discharge port area of 150%, the dot area changes from $S_2$ to $S_1$. Assuming that the opening areas of the liquid discharge ports situated at both ends in the arrangement thereof in FIG. 8 are increased by 50% more than the opening area of 100% of the liquid discharge port situated at the central position and the change of temperature depending on positions of the liquid discharge ports does not occur, the dot areas resulting from the recording on the material to be recorded are represented by $S_2$ at the central portion and by $S_1$ at both end portions as can be seen in FIG. 10. In actuality, however, a temperature gradient is produced on the substrate 703, as a result of which the temperature of the recording liquid to be ejected increases thereby changing the viscosity of the recording liquid. The dot area formed of the liquid droplet ejected from the central portion is, therefore, kept equal to those at both end portions, as designated in FIG. 10.

Since the heights of the liquid discharge ports 704 are defined to fixed level, according to the above described embodiment, for example, a photosensitive material of uniform thickness or a metal plate on which etching work may be conducted can be utilized, leading to the provision of a liquid jet recording head most suitable for mass-production because of simplicity and at low cost.

Figure 11:
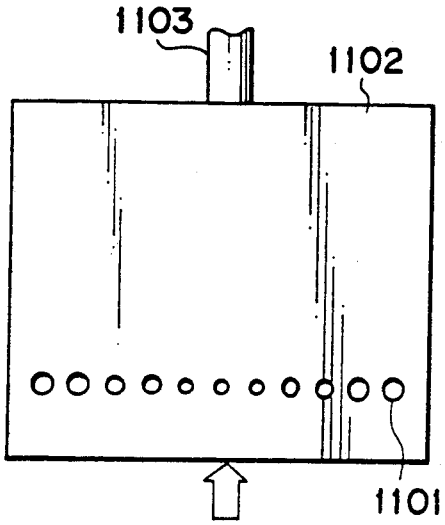
FIG. 11 is a front view of another embodiment of the present invention.
Figure 12:
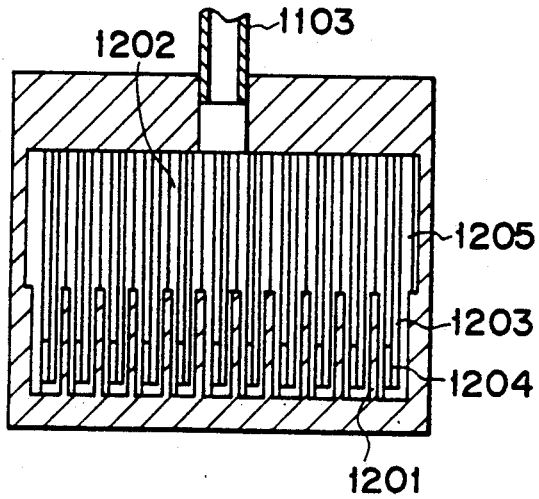
FIG. 12 is a sectional view taken along a direction parallel to the plane of the paper of FIG. 11.
Figure 13:
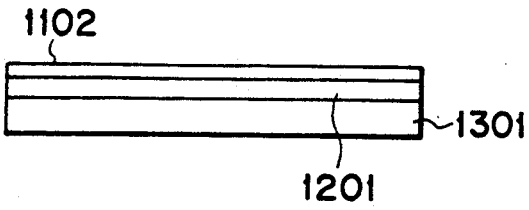
FIG. 13 is a side view viewed from the direction of an arrow in FIG. 11.

FIGS. 11 to 13 show another preferred embodiment of the present invention. This embodiment is applied to a type of liquid jet recording head in which liquid discharge ports are arranged in the direction orthogonal with the main direction of movement of recording liquid in liquid passages. In FIG. 12, 1204 denotes an electrical heater, that is, electrothermal converter, and 1205 is an electrode for supplying an electric signal to the electrothermal converter 1204. In this embodiment, liquid discharge ports 1101 are arranged in the form of a single line on a top plate 1102 and at positions corresponding to those of the electrothermal converters 1204. The areas of the liquid discharge ports 1101 in this embodiment also gradually increase toward both end portions from a central portion in the arrangement of the liquid discharge ports. In this case, the liquid discharge ports 1101 are opened on the top plate 1102. The liquid passage patterns of liquid passages 1203 formed on a substrate 1301 by using photosensitive resin or the like can be prepared with uniform dimensions. The liquid discharge ports 1101 may be fabricated on the top plate 1102 with sufficient accuracy in a simple process by changing only the sizes and the configurations of the liquid discharge ports as shown in the figures. Numeral 1201 denotes a liquid passage wall defining each liquid passage 1203 and 1202 designates a common liquid chamber for storing recording liquid supplied to each liquid passage 1203. To the common liquid chamber 1202 is supplied the recording liquid from an external tank (not shown) through a liquid supply pipe 1103.

Figure 14:
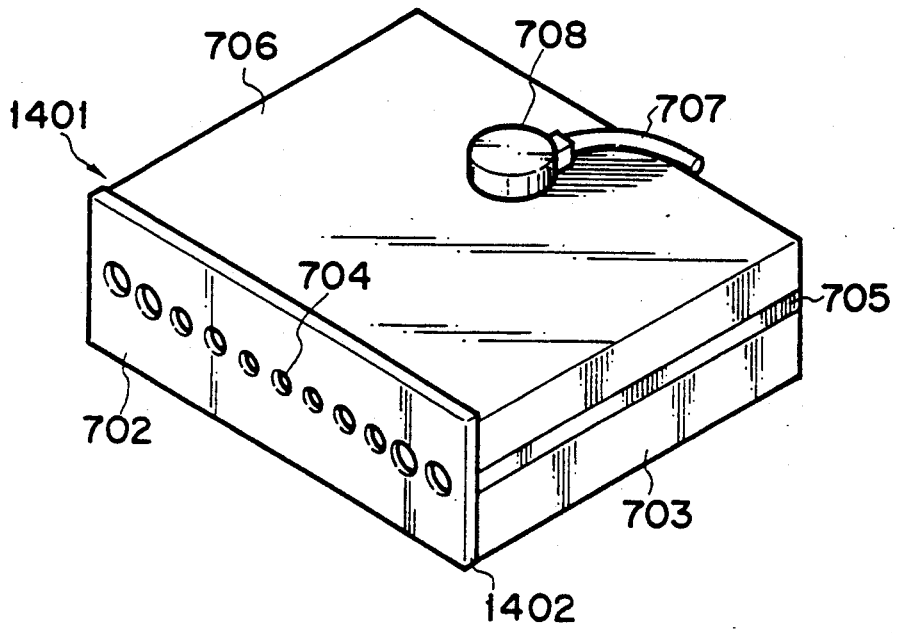
FIG. 14 is a perspective view illustrating the construction of a still another embodiment of the present invention.
Figure 15:
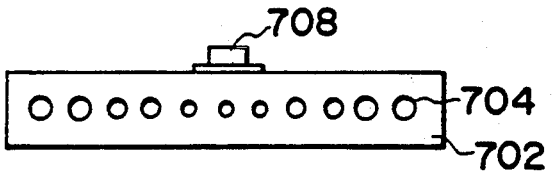
FIG. 15 is a front view of FIG. 14.

FIGS. 14 and 15 show still another preferred embodiment of the present invention. The construction of a liquid recording head of this embodiment is basically equal to that shown in FIG. 7 except that a liquid discharge port face 702 is manufactured as a discharge port forming plate 1402 separately from the main body of a head. Other formation, functions and effects of this embodiment are not different from those of the embodiment shown in FIG. 7, therefore, further explanation will be saved. It will be appreciated that liquid passages and liquid passage walls in the present embodiment may be also formed of photosensitive resin or the like with easiness similarly to prior art and besides, liquid discharge ports 704 may be formed with complete accuracy in a simple process separately from the other processes.

In the embodiments mentioned before, the opening areas of the liquid discharge ports gradually increase little by little at the rate of, for example, 50% from the liquid discharge port located at a central portion toward the liquid discharge ports located at end portions of the arrangement thereof. It is preferable to limit the gradually increasing rate of the opening areas of the liquid discharge ports to less than 50%, because further rise in the gradually increasing rate of the opening areas may possibly cause recording density at both the end portions to be higher than that at the central portion of a substrate.

It should be noticed that the rate or tendency of the gradual increase of the opening areas of the discharge ports be determined based on computation and experiments from the viewpoints of the construction, dimension and material of a recording head itself and the heating value, number, etc., of an electrothermal converter as a thermal energy generating means.

The construction of the recording head according to the present invention is not necessarily limited to such types as explained in the foregoing description of the preferred embodiments in which the opening areas of the liquid discharge ports gradually increase from that of the liquid discharge port disposed at the central portion to those of the liquid discharge ports disposed at both the end portions in the positional disposition thereof. That is to say, if a temperature gradient produced, during recording, on the substrate of the recording head does not substantially adversely influence the uniformity of recording density, the opening areas of the liquid discharge ports need not be necessarily increased from that of the liquid discharge port placed at the central portion toward those of the liquid discharge ports placed at both the end portions on the substrate.

Figure 16:
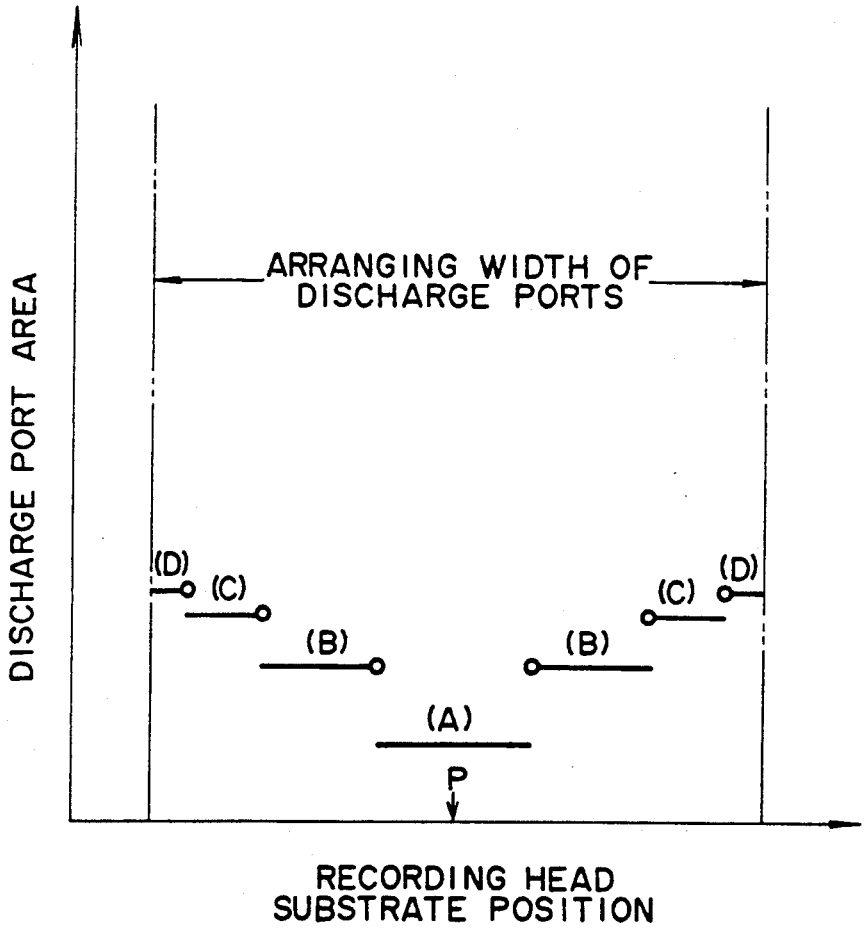
FIG. 16 is an explanatory view for explaining the relation between recording head substrate positions and discharge port areas in a further embodiment of the present invention.

For example, such a construction of liquid discharge ports in a recording head of a further embodiment of the present invention of FIG. 16 may be designed that a plurality of groups each consisting of a plurality of desired liquid discharge ports are formed as units and the opening areas of liquid discharge ports belonging to respective groups gradually become larger from those of the liquid discharge ports belonging to one unit group at a central position P toward those of the liquid discharge ports belonging to both end unit groups in the arrangement of the groups in a recording head.

In the embodiment shown in FIG. 16, the respective liquid discharge ports located within a central region (A) of the arrangement of the groups consisting of the liquid discharge ports have the substantially same or the same opening areas. Similarly, the opening areas of the discharge ports located within each arrangement region (B), (C) and (D) respectively are substantially equal or equal. The opening areas of the liquid discharge ports become sequentially larger from those of the liquid discharge ports arranged at region (A) toward those arranged at the regions of (B), (C) and (D), among the regions in the arranging width of the liquid discharge ports. The number of liquid discharge ports provided within each region for arranging the liquid discharge ports and the sized relation of the opening areas of liquid discharge ports between respective arrangement regions are suitably determined relying on the size of a recording head, recording density, the property of employed recording liquid, driving conditions of a recording head, etc.

As explained above in the foregoing preferred embodiments, according to a liquid jet recording head of the invention, the opening areas of liquid discharge ports located at both end portions are larger than that of a liquid discharge port located at a central portion in the arrangement of a plurality of liquid discharge ports and accordingly, the nearer the recording liquid approaches the end portions, the higher the viscosity of recording liquid becomes relative to that at the central portion, because of temperature difference. The volume of the liquid droplets discharged from the liquid discharge ports at the central portion and the two end portions in the recording head, however, is kept equal, which contributes in obtaining a recorded image with substantially uniform recording density.

Figure 17:
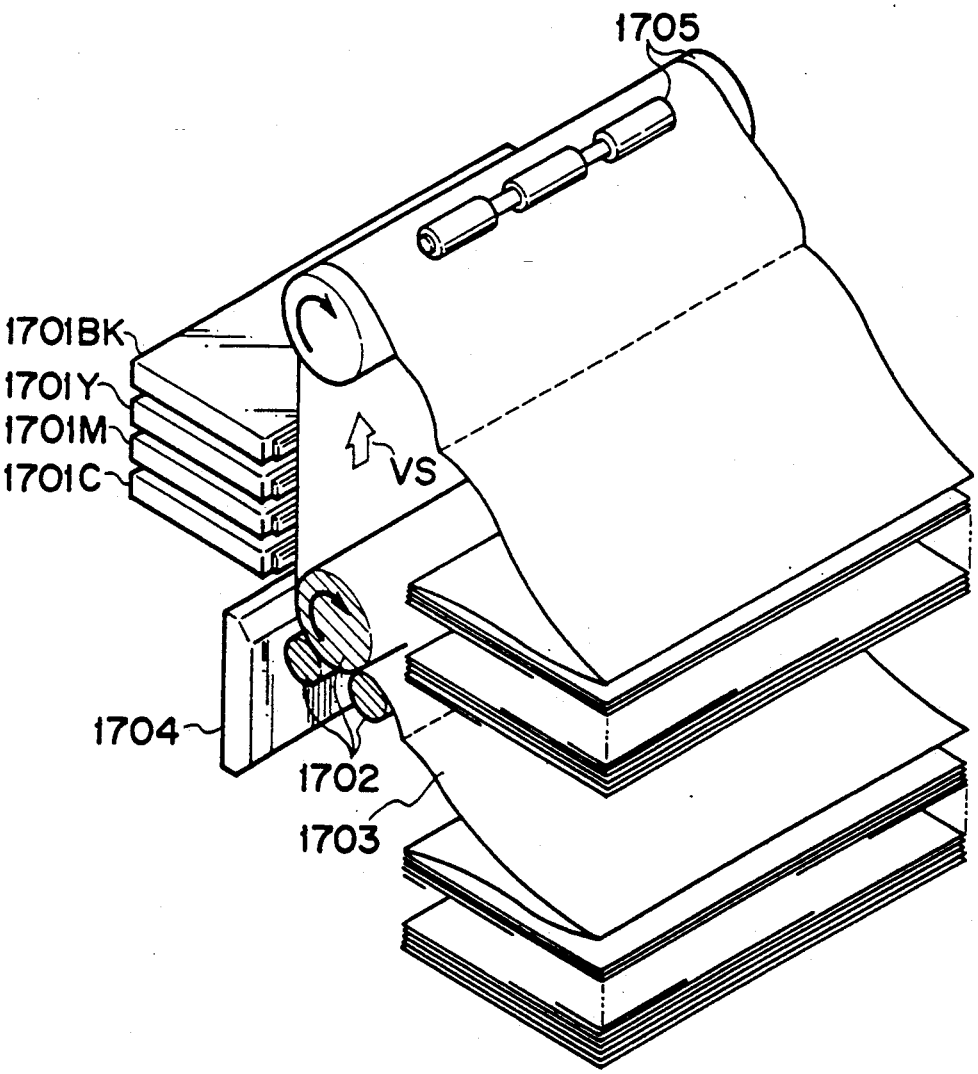
FIG. 17 is a perspective view of one form of a color line printer as a recording apparatus to which one embodiment of the present invention is applied.

A line printer as shown in FIG. 17 which is capable of performing full-color recording may be constructed by the employment of the recording head mentioned above.

In FIG. 17, 1702 and 1705 designate carrying means consisting of a plurality of rollers provided for sandwiching and carrying a recording medium 1703 toward a sub-scanning direction Vs. Reference numerals 1701BK, 1701Y, 1701M and 1701C are respectively full multi-type recording heads capable of recording in black, yellow, magnnat and cyan in which nozzles are disposed along the entire width of the recording medium 1703. The recording heads are arranged regularly in the order as specified above from the downstream side of the direction for carrying the recording medium.

Numeral 1704 denotes a recovering system which faces the recording heads 1701BK to 1701C in place of the recording medium 1703 in order to recover the discharge capabilities of the respective recording heads.

The present invention exhibits a most excellent effect particularly on an ink jet recording head or recording apparatus of the type that recording is conducted by taking advantage of thermal energy and forming flying liquid droplets, among various ink jet recording systems.

It is preferable for the typical construction and principle of the ink jet recording head or recording apparatus to adopt a basic principle disclosed in the specifications of, for instance, U.S. Pat. Nos. 4723129 and 4740796. This system of the recording head or recording apparatus may be applied to both a so-called on-demand type and a continuous type. The on-demand type is especially effective, because at least one driving signal which causes abrupt temperature rise exceeding the necleate boiling point in recording liquid is applied to electrothermal converters arranged at positions corresponding to the positions of liquid passages where the recording liquid (ink) is stored, in response to recording information, as a result, thermal energy is generated in the electrothermal converters and film boiling arises in the recording liquid in the vicinity of the thermal acting face of the recording head, which causes bubbles to be produced in the recording liquid that correspond to the driving signals on a one to one basis. Active forces generated in the processes of expansion and contraction of the bubbles induces the recording liquid to be ejected to atmosphere through liquid discharge ports, thereby at least one liquid droplet being formed. The driving signal in the form of pulsation permits the bubbles to be expanded or contracted rapidly and properly, so that it can achieve discharge result particularly excellent in responsiveness and is more preferable. Examples of the driving signal in the form of pulses disclosed in the specifications of U.S. Pat. Nos. 4,463,359 and 4,345,262 may be suitable. Further, the adoption of the condition, which is disclosed in the specification of U.S. Pat. No. 4,313,124 of the invention relating to temperature-rise ratio on the thermal acting face, makes it possible to perform a more prominent recording by the recording head of the present invention.

The construction of recording head of the present invention may include various constructions such as the combination type (linear liquid passages or bent liquid passages) of the liquid discharge ports, the liquid passages and the electrothermal converters that are disclosed in the above specifications. In addition thereto, the present invention may involve a construction that a thermal acting part is arranged at a bending region, which is disclosed in the specification of U.S. Pat. No. 4,558,333, and a construction making use of the disclosure of the specification of U.S. Pat. No. 4459600.

A recording head of full line type having length corresponding to a maximum width of recording medium on which recording can be made by a recording apparatus may include the combination of a plurality of recording heads described before, for meeting the length, or a unitary formation as one recording head. Either recording head plays a more effective role for achieving the above-mentioned effects, according to the present invention.

Moreover, the present invention is significantly effective where an exchangeable chip type recording head in which electrical connection to the main body of apparatus or the supply of ink from the main body of apparatus is enabled because of its installation on the main body of apparatus or a cartridge type recording head in which an ink supply tank is integrally provided in a recording head itself is employed.

It is desirable to additionally provide a recovering means or a preliminary auxiliary means, etc., for a recording head which is provided as a component of a recording apparatus of the present invention, because the effects of the present invention can be more stable. Exemplary means of the above-described means include capping means for a recording head, cleaning means, pressurizing or intake means, electrothermal converters, heating elements other the electrothermal converters them or preliminary heating means consisting of the combination of the electrothermal convertors and the other heating elements. The execution of a preliminary discharge mode in which a preliminary discharging is conducted separately from a record mode is useful for achieving a stable recording.

The recording mode of a recording apparatus may include not only a recording mode consisting of only main color such as black but also a recording mode by a construction of an integrally formed recording head or by a combination of a plurality of recording heads. Furthermore, the present invention is extremely effectively applied to an apparatus provided with multiple colors consisting of different colors or at least one of full colors formed through color mixture.

Additionally, the formations of a recording apparatus provided with a recording mechanism using a liquid jet recording head of the present invention may involve a means used as an image output terminal of an information processing unit such as a computer as well as a copying machine combined with a reader, etc., and a facsimile machine having a transmission/receiving function.

Figure 18:
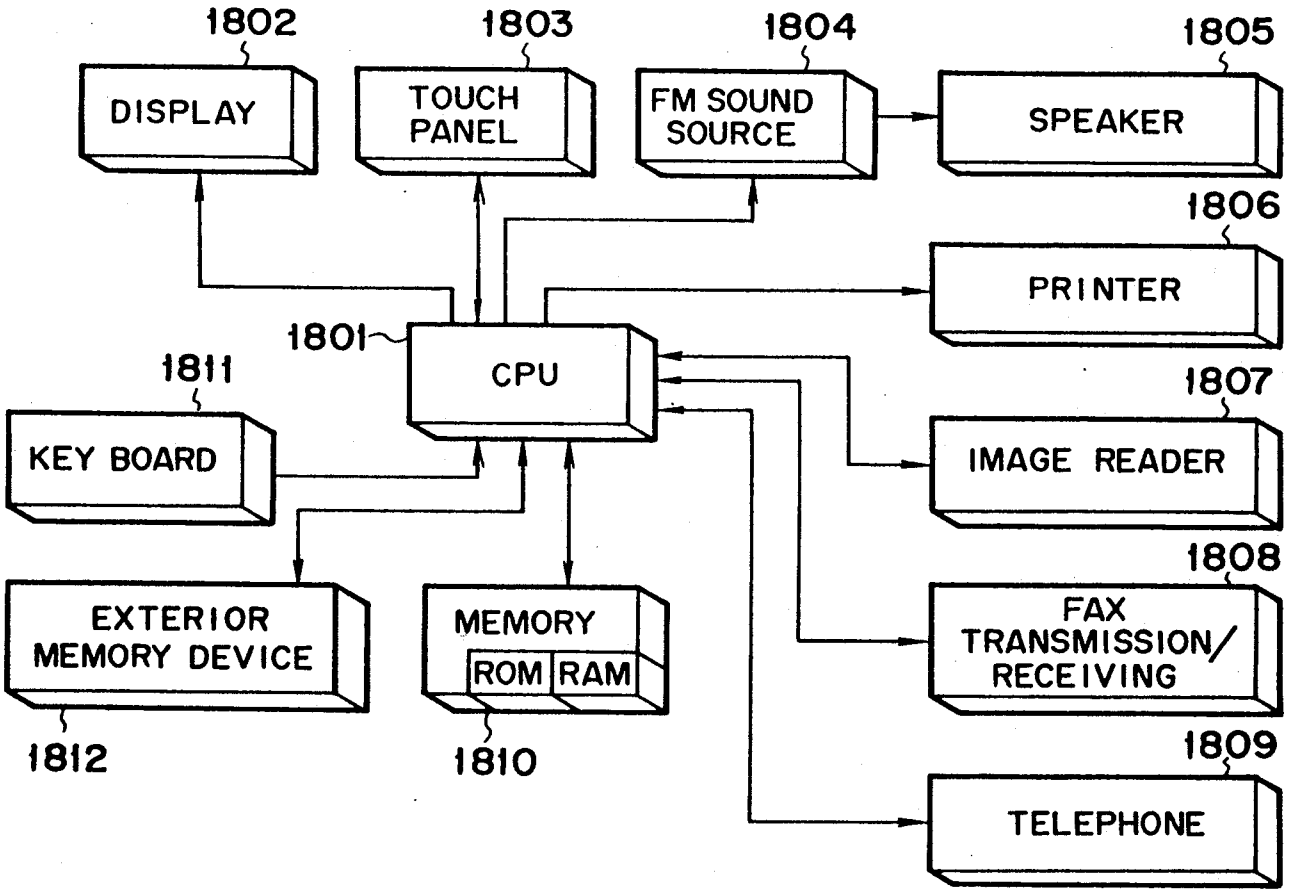
FIG. 18 is a block diagram showing a schematic construction of an information processing unit to which the present invention is applied.

FIG. 18 is a block diagram showing a schematic construction of an information processing unit having functions as a word processor, a personal computer, a facsimile machine and a copying machine to which the recording apparatus of the present invention is applied.

In FIG. 18, 1801 denotes a control part for controlling the whole of an apparatus which is provided with a CPU such as a microprocessor or various kinds of I/0 ports, and serves to output control signals or data signals to various parts or input control signals or data signals from various parts for controlling. Numeral 1802 is a display on the display image screen of which various types of menus, document information and image data read by an image reader numeral 1807 or the like are displayed. 1803 is a transparent and pressure sensitive touch panel provided on the display 1802 which is capable of inputting items or coordinate positions or the like on the display 1802 by depressing the surface thereof by means of fingers.

Numeral 1804 denotes an FM (Frequency Modulation) sound source part which stores music information prepared by a music editor or the like in a memory 1810 or an exterior memory device 1812 as digital data, reads it from the memories and performs FM modulation. An electric signal outputted from the FM sound source part 1804 is converted into audible sound by a speaker 1805. A printer part 1806 to which a recording apparatus of the present invention is applied is used as an output terminal of a word processor, a personal computer, a facsimile machine and a copying machine.

Numeral 1807, which denotes an image reader which serves to photoelectrically read and input original data, is disposed on the way of a carrying route of originals and reads facsimile originals and copied originals as well as other various kinds of originals. Numeral 1808 designates a transmission/receiving part of a facsimile (FAX) which serves to receive and decode the facsimile transmission of the original data read by the image reader 1807 or a transmitted facsimile signal and is provided with an interface function with an exterior side. Numeral 1809 is a telephone part having a variety of functions for telephone such as functions for an ordinary telephone, a caretaking telephone, etc.

Numeral 1810 designates a memory including a ROM which stores a system program or manager program and other application programs, or character fonts, dictionaries, etc., an application program loaded from the exterior memory device 1812, document information, a video RAM or the like.

Numeral 1811 is a keyboard which serves to input document information, various kinds of commands or the like.

In the exterior memory device 1812 using a floppy disk or a hard disk, etc. as a recording medium are loaded document information, music or sound information or the application program of a user and so on.

Figure 19:
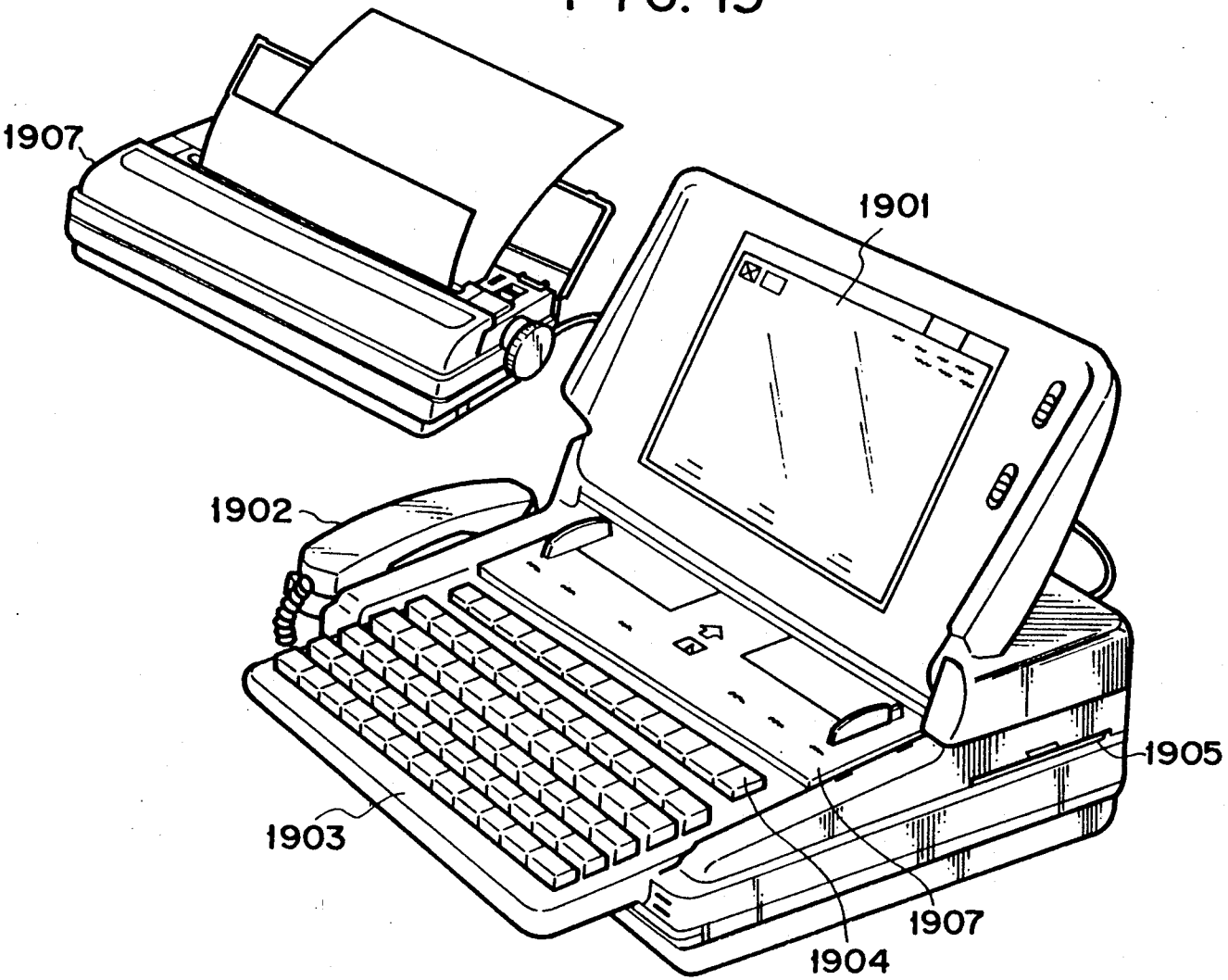
FIG. 19 is a typical sketch of the information processing unit shown in FIG. 18

FIG. 19 is a typical sketch of an information processing unit shown in FIG. 18.

In FIG. 19, 1901 is a flat panel display using liquid crystal or the like and serves to display various menus or graphic information and document information, etc. The touch panel 1803 is disposed on this display 1901 and coordinates can be inputted or items can be specified and inputted through depression of the surface of the touch panel 1803 by means of fingers. Numeral 1902 is a handset employed when the unit functions as a telephone set. A keyboard 1903 is detachably connected to the main body of the information processing unit and capable of inputting all sorts of document information and different data. Many function keys or the like are installed on the keyboard 1903. Numeral 1905 indicates an insert port of a floppy disk to the exterior memory device 1812.

Numeral 1906 designates a paper mounting part for mounting the original to be read by the image reader 1807. The read original is ejected from a back side of the information processing unit. A received facsimile or the like is recorded by an ink jet printer 1907.

The display 1802 may be a CRT type and is preferably in the form of a flat panel such as a liquid crystal display making use of a ferroelectric liquid crystal, because a compact, thin and light display can be obtained.

In the case where the above information processing unit functions as a personal computer or a word processor, various types of information inputted from the keyboard 1811 are processed in accordance with a prescribed program by the control part 1811 and outputted to the printer part 1806 as an image.

In the case where the information processing unit operates as a receiver of a facsimile machine, facsimile information inputted from the FAX transmission/-receiving part 1808 through a communication line is received and processed by the control part 1801 in accordance with a prescribed program and outputted to the printer part 1806 as a received image.

In the case where the information processing unit serves as a copying machine, an original is read by the image reader 1807 and the read original data is outputted to the printer part 1806 as a copied image through the control part 1801. In the case where the information processing unit functions as a transmitter of the facsimile machine, the original data read by the image reader 1807 is transmitted and processed by the control part 1801 in accordance with a prescribed program and then transmitted to the communication line through the FAX transmission/ receiving part 1808.

Figure 20:
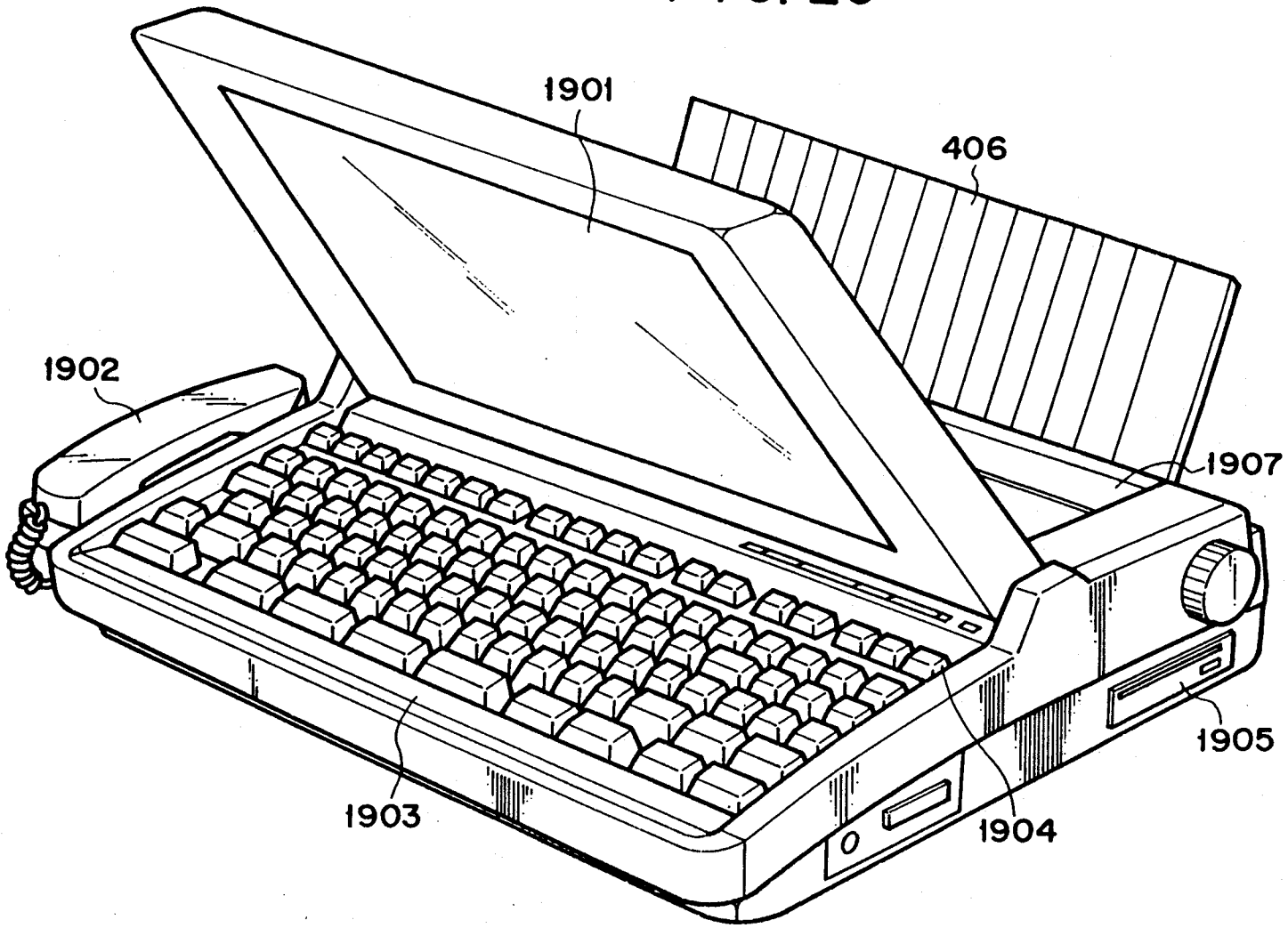
FIG. 20 is a typical sketch of an unitary information processing unit.

The information processing unit described above may be a unitary type that an ink jet printer is built in the main body as illustrated in FIG. 20. In this case, the portability of the information processing unit can be improved. In the same figure, portions having the same functions as those in FIG. 19 are marked by corresponding reference numerals.

Since the recorded image of high definition can be obtained at high speed and with less noise by the application of the apparatus of the present invention to the multifunctional information processing unit as set forth above, the functions of the information processing unit can be further enhanced.

As apparent from the foregoing description, since the liquid discharge ports are so arranged that the opening areas of the liquid discharge ports for discharging recording liquid become gradually larger from that of the liquid discharge port located at a central portion toward those of the liquid discharge ports located at both ends, according to the present invention, the generation of change in liquid droplets discharged from the liquid discharge ports can be prevented, which would have arisen due to the difference of viscosity that is caused because the temperature of the recording liquid is higher at the central portion of the liquid passages and lower at both end portions thereof depending on the arrangement relation of thermal energy generating means, and a recorded image having no unevenness in recording density can be formed.

I claim:

1. An ink jet recording head comprising:

a plurality of discharge ports for discharging ink therethrough;

a plurality of ink paths each communicating with a different one of said discharge ports; and thermal energy generating means for generating thermal energy to be applied to the ink in said ink paths, wherein opening areas of said discharge ports located at each of two end regions of said head are larger than that of said discharge ports located at a central region of said head with respect to an arrangement direction of said discharge ports, and a pitch between said discharge ports is constant through a whole arrangement area of said discharge ports.

2. An ink jet recording head according to claim 1, wherein the ink is discharged through expansion and contraction of bubbles.

3. An ink jet recording head comprising:

a plurality of discharge ports for discharging ink therethrough;

a plurality of ink paths each communicating with a different one of said discharge ports; and thermal energy generating means for generating thermal energy to be applied to the ink in said ink paths, wherein opening areas of said discharge ports at each of two end regions of said head are larger than that of said discharge ports located at a central region of said head with respect to an arrangement direction of said discharge ports, and the opening areas gradually increase in size from the central region to the end regions with the opening areas of said discharge ports at the end regions being no more than 50% greater than the opening areas of said discharge ports at the central region.

4. An ink jet recording head according to claim 3, wherein the ink is discharged through expansion and contraction of bubbles.

5. A recording apparatus for recording on a recording medium, said apparatus comprising:

an ink jet recording head including a plurality of discharge ports for discharging ink therethrough, a plurality of ink paths each communicating with a different one of said discharge ports, and thermal energy generating means for generating thermal energy to be applied to the ink in said ink paths, wherein opening areas of said discharge ports located at each of two end regions of said head are larger than that of said discharge ports located at a central region of said head with respect to an arrangement direction of said discharge ports, and a pitch between said discharge ports is constant through a whole arrangement area of said discharge ports; and a carrying mechanism for carrying the recording medium.

6. A recording apparatus according to claim 5, wherein said recording head discharges the ink through expansion and contraction of bubbles.

7. A recording apparatus for recording on a recording medium, said apparatus comprising:
an ink jet recording head including
a plurality of discharge ports for discharging ink therethrough,
a plurality of ink paths each communicating with a different one of said discharge ports and
thermal energy generating means for generating thermal energy to be applied to the ink in said ink paths, wherein opening areas of said discharge ports at each of two end regions of said head are larger than that of said discharge ports located at a central region of said head with respect to an arrangement direction of said discharge ports, and the opening areas gradually increase in size from the central region to the end regions with the opening areas of said discharge ports at the end regions being no more than 50% greater than the opening areas of said discharge ports at the central region toward those of the liquid discharge ports located at both end portions in the arrangement of the liquid discharge; and
a carrying mechanism for carrying the recording medium.

8. An apparatus according to claim 7, wherein said recording head discharges the ink through expansion and contraction of bubbles.

9. An apparatus comprising:
an ink jet recording head including
a plurality of discharge ports for discharging ink therethrough,
a plurality of ink paths each communicating with a different one of said discharge ports, and
thermal energy generating means for generating thermal energy to be applied to the ink in said ink paths, wherein opening areas of said discharge ports located at each of two end regions of said head are larger than that of said discharge ports located at a central region of said head with respect to an arrangement direction of said discharge ports, and a pitch between said discharge ports is constant through a whole arrangement area of said discharge ports; and
a recording mechanism for recording by using said ink jet recording head.

10. An apparatus according to claim 9, wherein said recording head discharges the ink through expansion and contraction of bubbles.

11. An apparatus comprising:
an ink jet recording head including
a plurality of discharge ports for discharging ink therethrough,
a plurality of ink paths each communicating with a different one of said discharge ports and
thermal energy generating means for generating thermal energy to be applied to the ink in said ink paths, wherein opening areas of said discharge ports at each of two end regions of said head are larger than that of said discharge ports located at a central region of said head with respect to an arrangement direction of said discharge ports, and the opening areas gradually increase in size from the central region to the end regions with the opening areas of said discharge ports at the end regions being no more than 50% greater than the opening areas of said discharge ports at the central region; and
a recording mechanism for recording by using said ink jet recording head.

12. An apparatus according to claim 11, wherein said recording head discharges the ink through expansion and contraction of bubbles.

13. An information processing unit comprising:
a recording mechanism for recording with an ink jet recording head including
a plurality of discharge ports for discharging ink therethrough,
a plurality of ink paths each communicating with a different one of said discharge ports, and
thermal energy generating means for generating thermal energy to be applied to the ink in said ink paths, wherein opening areas of said discharge ports located at each of two end regions of said head are larger than that of said discharge ports located at a central region of said head with respect to an arrangement direction of said discharge ports, and a pitch between said discharge ports is constant through a whole arrangement area of said discharge ports.

14. An information processing unit according to claim 13, wherein said recording head discharges the ink through expansion and contraction of bubbles.

15. An information processing unit according to claim 13, wherein said information processing unit is a word processor.

16. An information processing unit according to claim 13, wherein said information processing unit is a facsimile machine.

17. An information processing unit according to claim 13, wherein said information processing unit is a copying machine.

18. An information processing unit according to claim 13, wherein said information processing unit is a terminal equipment of a computer.

19. An information processing unit comprising:
a recording mechanism for recording with an ink jet recording head including
a plurality of discharge ports for discharging ink therethrough,
a plurality of ink paths each communicating with a different one of said discharge ports, and
thermal energy generating means for generating thermal energy to be applied to the ink in said ink paths, wherein opening areas of said discharge ports at each of two end regions of said head are larger than that of said discharge ports at a central region of said head with respect to an arrangement direction of said discharge ports, and the opening areas gradually increase in size from the central region to the end regions with the opening areas of said discharge ports at the end regions being no more than 50% greater than the opening areas of said discharge ports at the central region.

20. An information processing unit according to claim 19, wherein said recording head discharges the ink through expansion and contraction of bubbles.

21. An information processing unit according to claim 19, wherein said information processing unit is a word processor.

22. An information processing unit according to claim 19, wherein said information processing unit is a facsimile machine.

23. An information processing unit according to claim 19, wherein said information processing unit is a copying machine.

24. An information processing unit according to claim 19, wherein said information processing unit is a terminal equipment of a computer.

* * * * *

UNITED STATES PATENT AND TRADEMARK OFFICE

CERTIFICATE OF CORRECTION

PATENT NO. : 5,175,567

DATED : December 29, 1992

INVENTOR(S) : NAOHITO ASAI

It is certified that error appears in the above-identified patent and that said Letters Patent is hereby corrected as shown below:

ON THE TITLE PAGE:

AT [54] TITLE

"POST" should read --PORT--.

AT [30] FOREIGN APPLICATION PRIORITY DATA

Insert,
--Jan. 24, 1991 [JP] Japan ..... 3-7227--.

SHEET 1 OF 13

Figure 2:
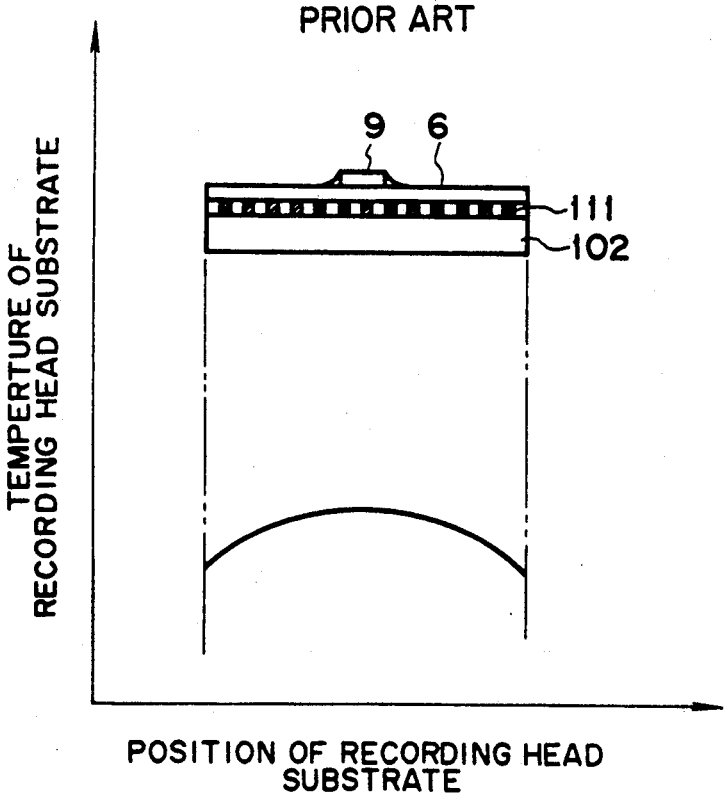
FIG. 2 PRIOR ART
FIG. 2 shows temperature distribution on a substrate of the conventional recording head shown in FIG. 1.
Figure 3:
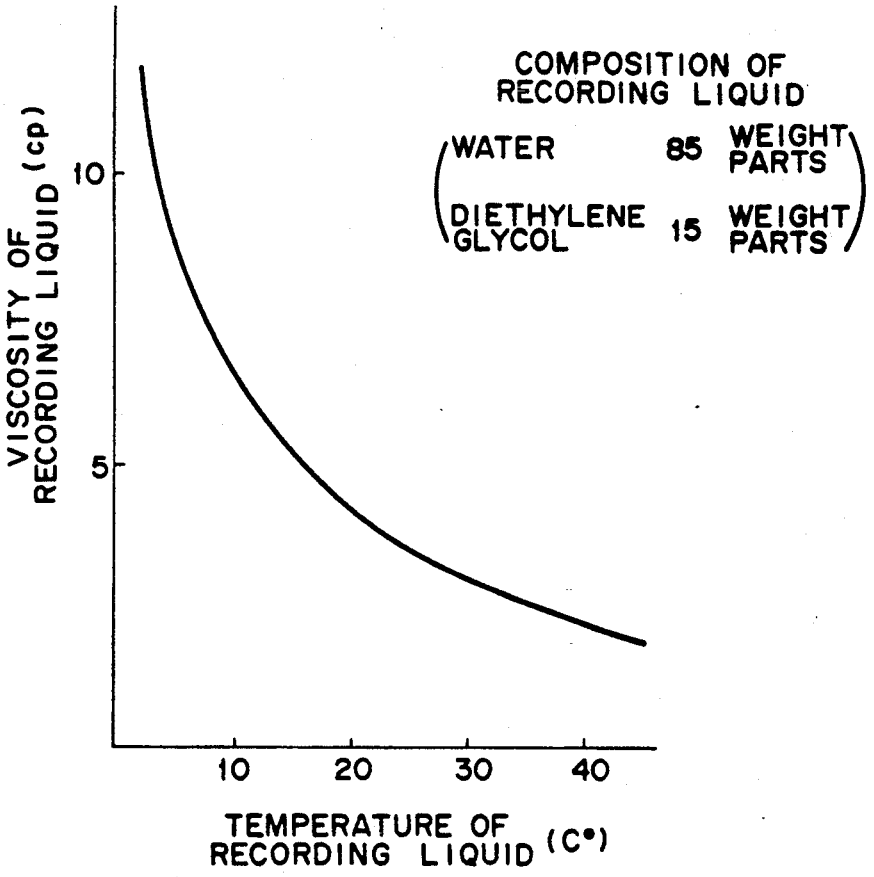
FIG. 3 PRIOR ART
FIG. 3 shows a characteristic curve illustrating a relation between the temperature of recording liquid and the viscosity of recording liquid.
Figure 6:
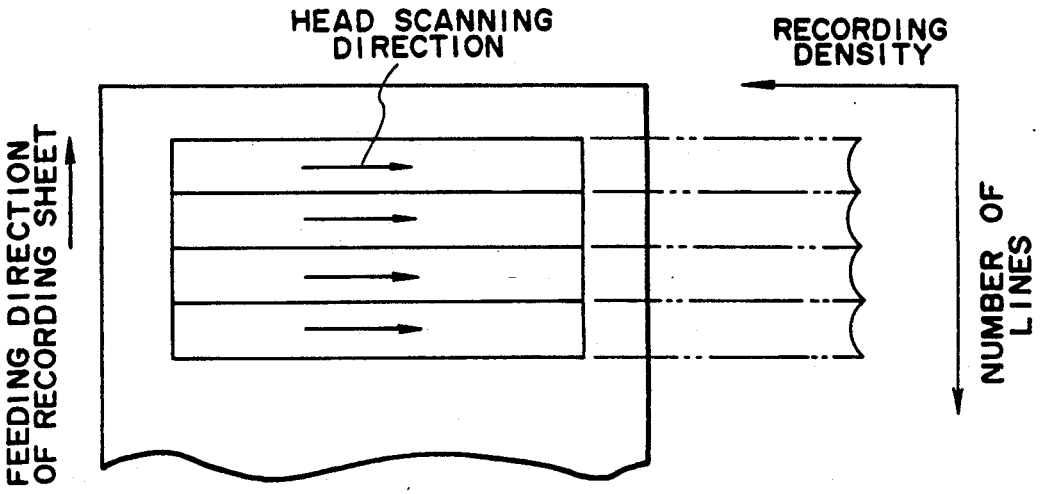
FIG. 6 PRIOR ART
FIG. 6 is an explanatory view indicating the generation of recording unevenness according to the conventional recording head.
Figure 4:
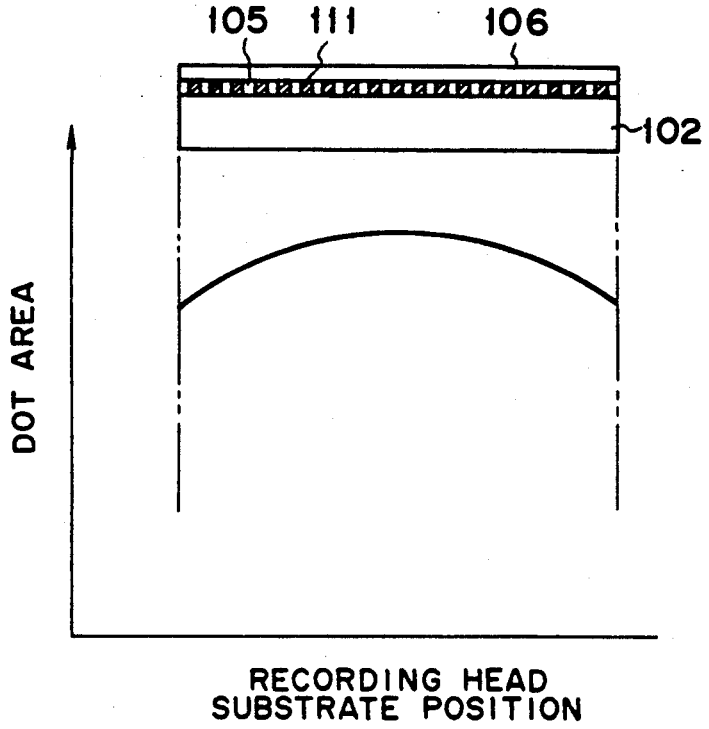
FIG. 4 PRIOR ART
FIG. 4 is an explanatory view showing the change of dot area in the conventional recording head.
Figure 5:
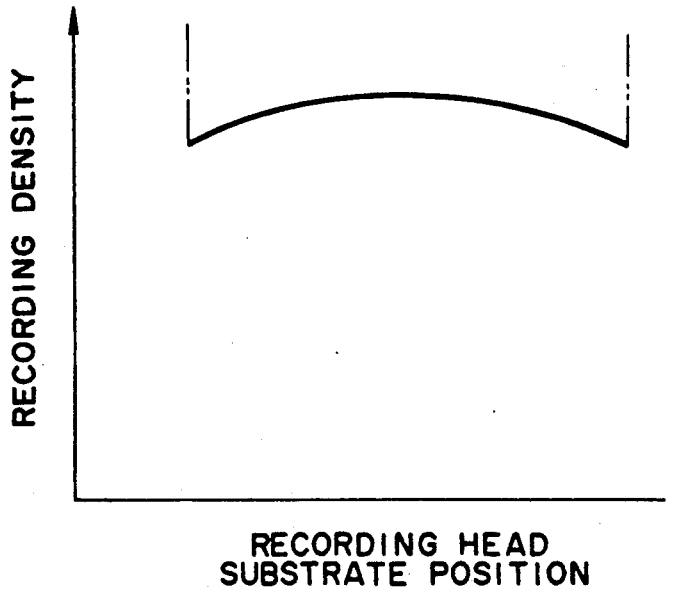
FIG. 5 PRIOR ART
FIG. 5 is an explanatory view showing the change of recording density in the conventional recording head.

FIG. 2, "TEMPERTURE" should read --TEMPERATURE--.

COLUMN 1

Line 4, "POST" should read --PORT--.
Line 45, "planer" should read --planar--.

COLUMN 3

Line 4, "droplet" should read --droplets--.
Line 39, "painted." should read --printed.--.

COLUMN 5

Line 6, "an" should read --a--.
Line 44, "to" should be deleted.

UNITED STATES PATENT AND TRADEMARK OFFICE

CERTIFICATE OF CORRECTION

PATENT NO. : 5,175,567

DATED : December 29, 1992

INVENTOR(S) : NAOHITO ASAI

It is certified that error appears in the above-identified patent and that said Letters Patent is hereby corrected as shown below:

COLUMN 6

Line 31, "at" should be deleted.

COLUMN 8

Line 30, "Vs." should read --VS.--.
Line 33, "magnnat" should read --magenta--.
Line 51, "4723129" should read --4,723,129-- and "4740796." should read --4,740,796.--.
Line 57, "necleate" should read --nucleate--.
Line 61, "information, as" should read --information. As--.
Line 68, "induces" should read --induce--.

COLUMN 9

Line 25, "4459600." should read --4,459,600.--.
Line 51, "other" should read --other than--.
Line 52, "them" should be deleted.
Line 53, "convertors" should read --converters--.

COLUMN 10

Line 14, "I/0" should read --I/O--.
Line 20, "numeral" should be deleted.
Line 21, "1803" should read --Numeral 1803--.

UNITED STATES PATENT AND TRADEMARK OFFICE

CERTIFICATE OF CORRECTION

PATENT NO. : 5,175,567

DATED : December 29, 1992

INVENTOR(S) : NAOHITO ASAI

It is certified that error appears in the above-identified patent and that said Letters Patent is hereby corrected as shown below:

COLUMN 11

Line 26, "control part 1811" should read --control part 1801--.
Line 47, "that" should read --in which--.

COLUMN 13

Line 7, "ports" should read --ports,--.
Line 19, "region toward" should read --region; and--.
Lines 20-22 should be deleted.
Line 54, "ports" should read --ports,--.

Signed and Sealed this

Twenty-third Day of November, 1993

Bruce Lehman

*Attest:*

BRUCE LEHMAN

*Attesting Officer*

*Commissioner of Patents and Trademarks*